US008382173B2

(12) United States Patent
Bingham

(10) Patent No.: US 8,382,173 B2
(45) Date of Patent: Feb. 26, 2013

(54) ADVERTISING DEVICE FOR AN IMPROVED GOLF BALL RETRIEVER

(76) Inventor: Edna Bingham, Garland, TX (US)

( * ) Notice: Subject to any disclaimer, the term of this patent is extended or adjusted under 35 U.S.C. 154(b) by 140 days.

(21) Appl. No.: 12/350,088

(22) Filed: Jan. 7, 2009

(65) Prior Publication Data

US 2009/0174202 A1 Jul. 9, 2009

Related U.S. Application Data

(60) Provisional application No. 61/019,515, filed on Jan. 7, 2008.

(51) Int. Cl.
*A63B 47/02* (2006.01)
*G09F 23/00* (2006.01)

(52) U.S. Cl. ..... 294/19.2; 40/124.06

(58) Field of Classification Search ..... 294/19.2, 294/209, 99.1; 40/124.06, 124.09; 56/328.1; 473/286, 460; 221/199, 307, 309
See application file for complete search history.

(56) References Cited

U.S. PATENT DOCUMENTS 2,027,546 A * 1/1936 Macdonald ..... 294/19.2
D226,407 S * 2/1973 Doman et al. ..... D3/260
4,088,251 A * 5/1978 Rodriguez ..... 224/626
4,678,108 A * 7/1987 Inman ..... 224/274
4,787,161 A * 11/1988 Feng ..... 40/334
4,798,219 A * 1/1989 Forde ..... 135/16
5,466,027 A * 11/1995 Hockey ..... 294/19.2
5,755,632 A * 5/1998 Eddy ..... 473/460
5,775,751 A * 7/1998 Nelson ..... 294/19.2
2005/0052040 A1* 3/2005 Hellerson ..... 294/19.2
2006/0055189 A1* 3/2006 Dalsing et al. ..... 294/19.2

* cited by examiner

*Primary Examiner* — Paul T Chin
(74) *Attorney, Agent, or Firm* — Shannon W. Bates; Klemchuk Kubasta LLP

(57) ABSTRACT

An advertising device for an improved golf ball retriever is provided. The golf ball retriever includes a hollow shaft made of a clear plastic material wherein an advertising slip can be placed into the hollow shaft by the use of a pole. The shaft may include a grip on one end for secure maneuvering of the golf ball retriever during retrieval. The shaft includes a suction cup with a hollow center on the opposite end where the grip may be located for retrieving a golf ball. The top end of the shaft also includes apertures in the shaft that allow a hanging device to be removably affixed to the shaft of the golf ball retriever. The top end of the shaft also has an end cap removably attached to the shaft to enclose the top end of the hollow shaft.

8 Claims, 3 Drawing Sheets

ADVERTISING DEVICE FOR AN IMPROVED GOLF BALL RETRIEVER

RELATED APPLICATION

This application claims priority to Provisional Application No. 61/019,515 filed on Jan. 7, 2008, with the title Advertising Device for an Improved Golf Ball Retriever.

BACKGROUND

1. Field of the Invention

The present invention relates generally to advertising devices for golf equipment and in particular to an advertising device for an improved golf ball retriever.

Retrieving golf balls during the course of play requires players to constantly bend over and/or dismount from golf carts in order to retrieve golf balls from the ground. In certain games played on the course, the number of golf balls to be retrieved is increased by the nature of the game. For example, the problem is further aggravated from the requirements of team members playing in a golf game called Scramble. Under the rules of that game, all members of a team individually and sequentially have to drive their golf balls off the tee. The position of the golf ball that goes the farthest or is in the best lie for the next shot is selected as the chosen position where all team members hit their second shot. The other team members have to retrieve their golf balls and reposition them at the position of the selected ball and then each of the members strike their balls again from that position. When players retrieve their balls for repositioning to the lie of the selected ball, the players often have to disembark from golf carts and then physically bend over to pick up their ball. The problem becomes further exacerbated when balls are to be retrieved from undesirable areas such as water traps, sand traps, high weeds, and brush where the golf player may risk injury from plants, insects and the like.

Organizations that hold tournaments often seek sponsors for their events. The sponsors are typically able to advertise their goods or services on golf related equipment, such as tee boxes, flags on the green, and the like. Even when tournaments are not being held, companies that would like to increase their exposure to the potential clientele of golf players advertise their goods or services on golf related equipment, such as golf bags and golf balls. The typical advertising methods involved with golf related equipment, however, are either too expensive because of the cost of the golf equipment involved, do not last long enough to impress the potential customer, or are printed on golf related equipment that is discarded by the potential customer because it is not useful.

The need exists, therefore, for an effective advertising method that is less costly but useful to target the potential customer base of golf players.

2. Description of Related Art

As a result of the problems associated with retrieving golf balls, there are a variety of golf ball retrievers known in the art. One category of golf ball retriever is characterized by a rake-like structure used to scoop a golf ball. Another category of golf ball retriever uses two circular members connected by a spring mechanism on the end of a shaft to pick a golf ball up. However, these prior designs are cumbersome to use and often unreliable. The prior designs are also unable to accommodate any advertising device.

Thus, there exists a need to be able to safely and effectively retrieve a golf ball without repeatedly bending over or from a golf cart and to capitalize on the advertising opportunity of providing a useful device with an advertisement.

BRIEF SUMMARY OF THE INVENTION

These and other objects are achieved by the device of the present invention. By eliminating the complex designs, which include bail members, springs, elastic materials and the like, the golf ball retriever of the present invention is easier to use and more securely captures a golf ball upon retrieval.

In accordance with one embodiment of the present invention, an advertising device for an improved golf ball retriever is provided. The golf ball retriever includes a hollow shaft made of a clear plastic wherein an advertising slip can be placed into the hollow shaft by the use of a pole so that a user can see the advertising slip through the shaft of the golf ball retriever. The advertising slip can be made of various paper or plastic products and is rolled into a cylinder shape so that it fits into the shaft of the golf ball retriever. The shaft may include a grip on one end for secure maneuvering of the golf ball retriever during retrieval. The shaft also includes a suction cup on the opposite end of the grip for retrieving a golf ball. To retrieve a golf ball on the course, a player can walk up to a ball, or drive the cart next to a ball, and simply place the suction cup of the golf ball retriever over the ball and press gently. The ball then remains in the suction cup. The player can then free his golf ball from the suction cup of the golf ball retriever for placement on the course for continued use. Thus, a player can retrieve his golf ball quickly without having to repeatedly bend over to retrieve a ball. The grip end of the shaft also includes apertures in the shaft that allow a hanging device to be removably affixed to the shaft of the golf ball retriever. A user can then attach the golf ball retriever to his bag, such as on the towel ring. The grip end of the shaft also has an end cap removably attached to the shaft to enclose the grip end of the shaft.

Other objects, features, and advantages of the present invention will become apparent with reference to the drawings and detailed description that follow.

DETAILED DESCRIPTION OF THE PREFERRED EMBODIMENT

All references cited herein are incorporated by reference to the maximum extent allowable by law. To the extent a reference may not be fully incorporated herein, it is incorporated by reference for background purposes and indicative of the knowledge of one of ordinary skill in the art.

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figures 1, 2, 2A:
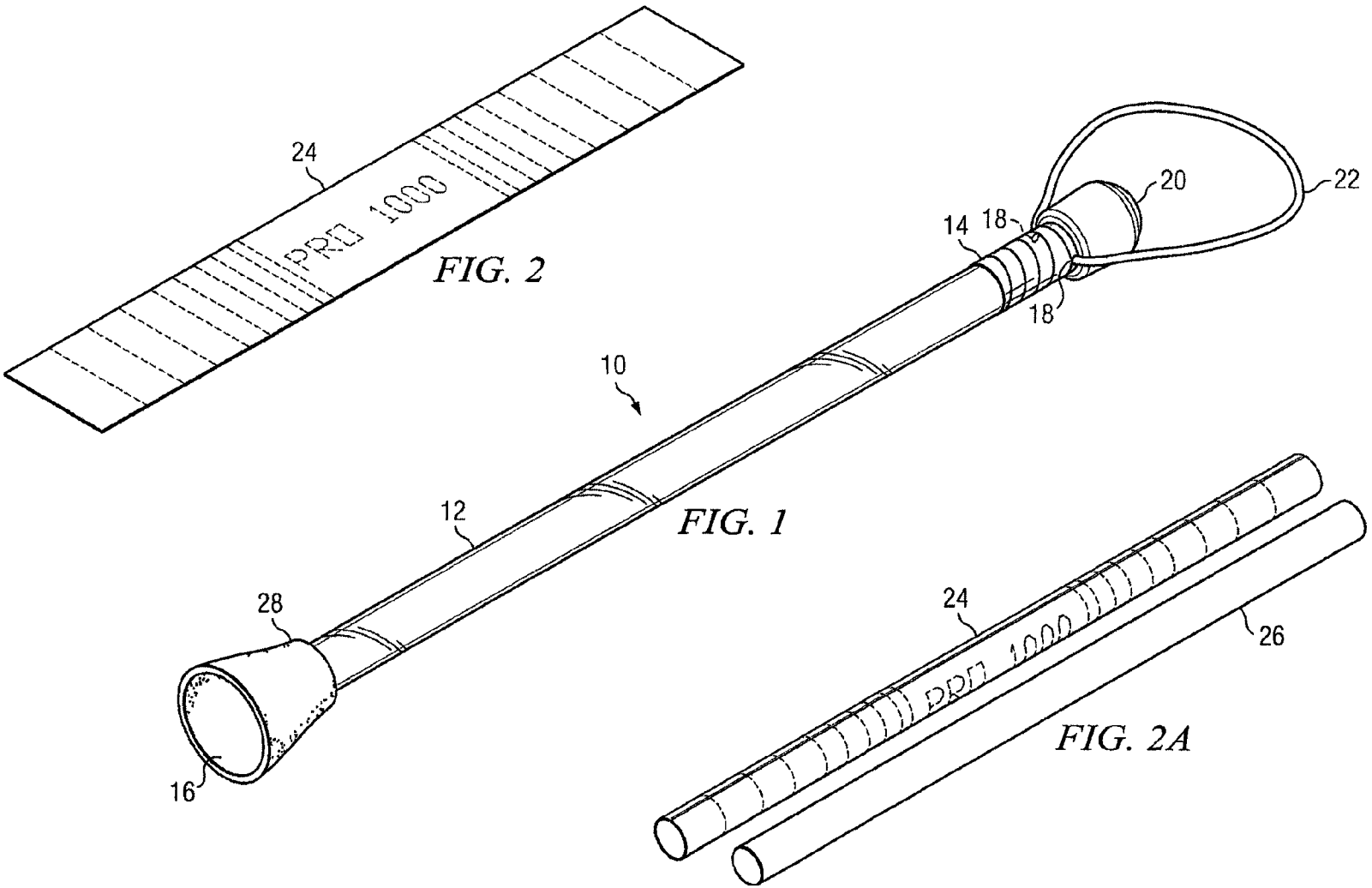
FIG. 1 is a perspective view of an improved golf ball retriever in accordance with one embodiment of the present invention.
FIG. 2 is a perspective view of an advertising slip to be used with an improved golf ball retriever in accordance with one embodiment of the present invention.
FIG. 2A is a perspective view of an advertising slip and insertion device to be used with an improved golf ball retriever in accordance with one embodiment of the present invention.

FIG. 1 is a perspective view of an improved golf ball retriever 10 in accordance with one embodiment of the present invention. FIG. 2 is a perspective view of an advertising slip 24 used with the improved golf ball retriever 10 in accordance with one embodiment of the present invention. FIG. 2A is a perspective view of an advertising slip 24 and insertion device 26 used with the improved golf ball retriever 10 in accordance with one embodiment of the present invention. The golf ball retriever 10 includes a shaft 12 made of a sturdy clear polymer-based plastic. One skilled in the art will understand that the utility of the golf ball retriever 10 is not diminished by the use of other materials for the shaft 12, such as any sturdy clear material that allows the advertising slip 24 to be seen through the shaft 12. The shaft 12 is hollow such that an advertising slip 24 can travel through the shaft 12 when rolled into a cylinder shape 24 as shown in FIG. 2A.

The top end of the shaft 12 includes an end cap 20 that includes threads that mate to the hollow inside of the shaft 12 to enclose the top end of the shaft 12. One skilled in the art will understand that the end cap 20 can also be made to fit snugly inside the shaft 12 so that the end cap 20 may be pushed into the shaft 12 or pulled out of the shaft 12. In accordance with one embodiment of the present invention, the end cap 20 has a diameter of approximately 1" and is made of rubber. On the top end of the shaft 12, the shaft 12 also includes apertures 18 to which a hanging device 22 can be attached to the golf ball retriever 10 so that the golf ball retriever 10 can be hung on a player's golf bag. One skilled in the art will understand that the hanging device 22 can be made with any number of materials and maintain the utility of the hanging device 22, such as thread, rubber, or wire. In accordance with one embodiment of the present invention, the diameter of the apertures 18 are approximately ¼" and are drilled into the shaft 12 and the hanging device 22 is approximately 14".

At the top end of the shaft 12, the shaft 12 may also be covered with a tape grip 14 similar to a baseball bat. One skilled in the art will understand that the grip 14 can be comprised of a number of materials and forms, such as a molded rubber grip similar to a golf club. The point at which the inside diameter of the shaft 12 decreases 32 may also be positioned at a point where the optional grip 14 does not cover any portion of the advertising slip 24 when inserted into the shaft 12.

On the opposite end of the shaft 12 from the end cap 20, the golf ball retriever 10 includes a suction cup 16 made of rubber. In accordance with one embodiment of the present invention, the suction cup 16 has a diameter of approximately 1". The suction cup 16 is removably attached to the shaft 12 by the sleeve 28 of the suction cup 16. An advertising slip 24 is constructed from a laminated paper advertisement and has a width, when rolled, that is almost equal to the diameter of the inside of the shaft 12. The advertising slip 24 is rolled by its width to form a tubular shape as in FIG. 2A and is placed inside the shaft 12 with a pole 26. One skilled in the art will understand that the advertising slip 24 can be made from any number of materials, such as any flexible plastic or paper product, without decreasing the utility of the advertising slip 24.

Figure 3:
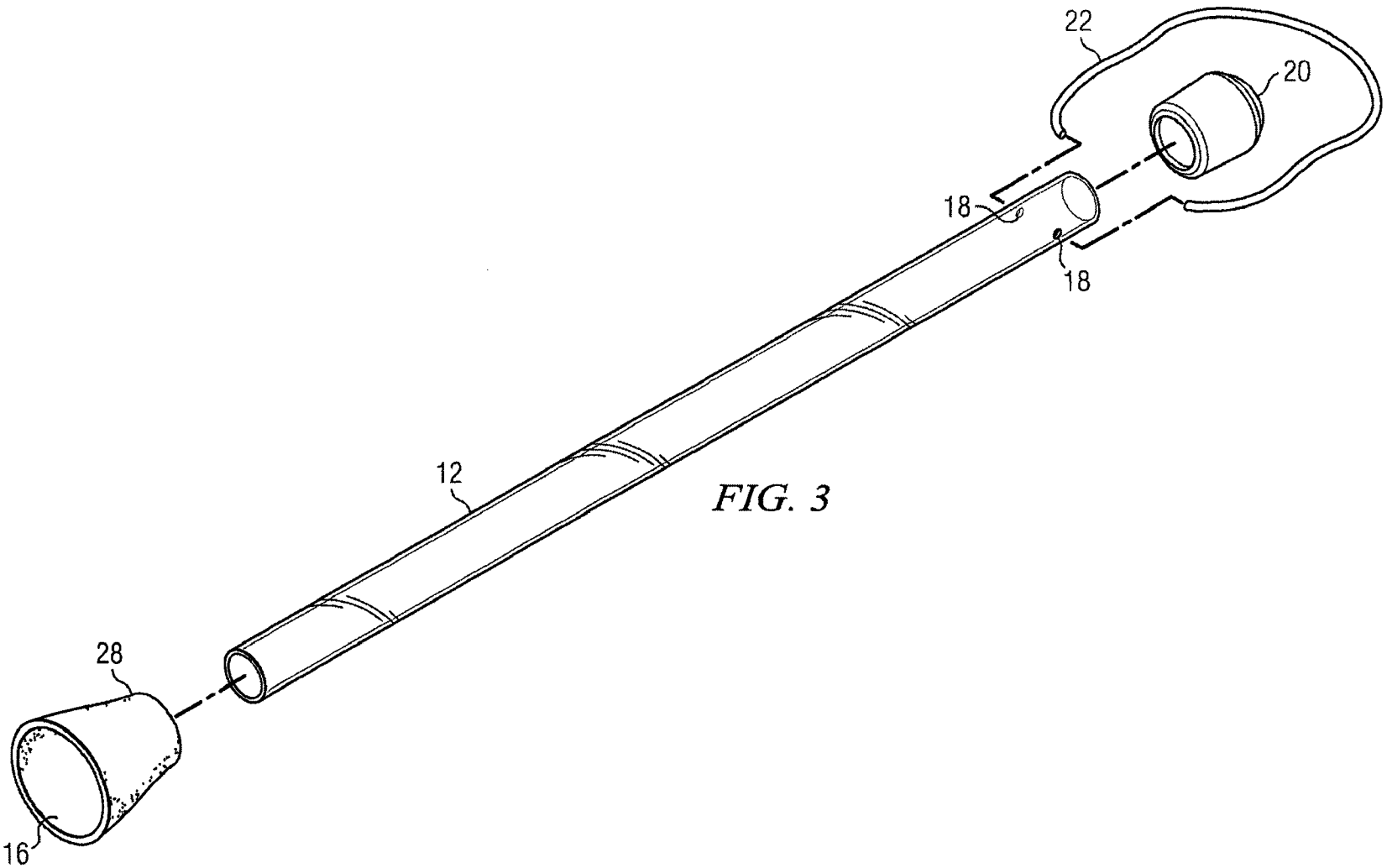
FIG. 3 is an exploded view of an improved golf ball retriever in accordance with one embodiment of the present invention.
Figure 4:
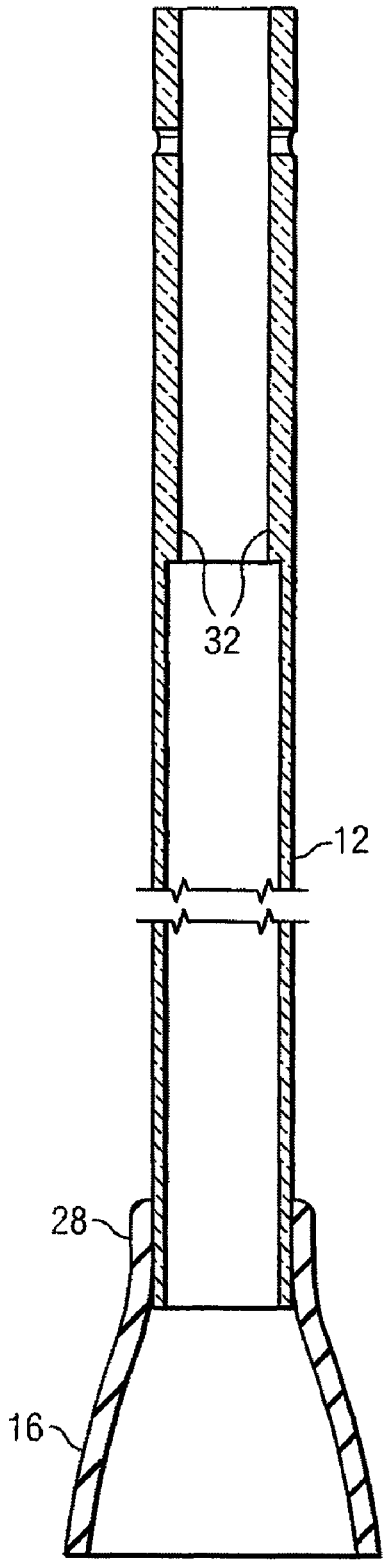
FIG. 4 is cross-section view of an improved golf ball retriever in accordance with one embodiment of the present invention.

FIG. 3 is an exploded view of an improved golf ball retriever 10 in accordance with one embodiment of the present invention. FIG. 4 is a cross-section view of an improved golf ball retriever 10 in accordance with one embodiment of the present invention. To prepare the improved golf ball retriever 10 for use or sale, the suction cup 16 is removed from the shaft 12 by pulling the suction cup sleeve 28 free from the shaft 12. The previously printed advertising slip 24 is then rolled into a cylinder shape, as demonstrated in FIG. 2A, to a diameter that is slightly smaller than the diameter of the inside of the hollow shaft 12. The rolled advertising slip 24 may be secured in its cylinder shape using tape, glue, or any other adhesive material. The advertising slip 24 is then placed inside the shaft 12 and moved to a position inside the clear shaft 12 so that the advertising slip 24 can be seen through the shaft 12 of the golf ball retriever 10. The advertising slip 24 is placed into the shaft 12 of the golf ball retriever 10 with the use of an insertion device 26 that has a diameter just slightly smaller than the diameter of the inside of the shaft 12. The insertion device 26 can be a pole made of any material sturdy enough to push the advertising slip 24 up through the hollow shaft 12 of the golf ball retriever 10. To assure proper placement of the advertising slip 24 within the shaft 12, the diameter of the inside of the shaft can decrease at a predetermined point 32 to stop the advertising slip 24 at the predetermined point.

Once the advertising slip 24 has been placed into the shaft 12 of the golf ball retriever 10, a user can hang the golf ball retriever 10 on his bag using the hanging device 22. The hanging device 22 can be attached to a towel ring on a golfer's bag or any other place that the user desires. When needing to retrieve a ball, the user removes the golf ball retriever 10 from his bag and approaches a ball. Without the need to bend over, the user simply holds the golf ball retriever 10 by the shaft 12 and then places the suction cup 16 over the golf ball. The user then presses the suction cup 16 of the golf ball retriever 10 onto the golf ball and lifts the golf ball retriever 10 with the ball secured in the suction cup 16. If the user desires to continue using the ball that has just been retrieved, he simply removes the golf ball from the suction cup 16.

Even though examples discussed herein are applications of the present invention employing an advertising device for an improved golf ball retriever, the present invention can also be employed for use of advertising with other types of retrieving devices, such as those for tennis balls or baseballs.

It should be apparent from the foregoing that an invention having significant advantages has been provided. While the invention is shown in only a few of its forms, it is not just limited but is susceptible to various changes and modifications without departing from the spirit thereof.

I claim:

1. A method of constructing an advertising device, the advertising device comprising a cylindrical hollow shaft, a cap on a first end of the hollow shaft, a cup on a second end of the hollow shaft, the cup being shaped to form to a ball and facing away from the hollow shaft to facilitate retrieving a golf ball, and an advertising slip that displays an advertisement along the hollow shaft, the method comprising:

forming the cylindrical hollow shaft from a clear polymer-based plastic material;

installing the cap made of a molded resilient material to the first end of the hollow shaft;

forming the advertising slip by rolling into a cylinder a flexible material with a printed advertisement thereon, the advertisement disposed on an exterior surface of the advertising slip;

inserting the advertising slip into the hollow shaft through the second end of the hollow shaft such that the exterior surface of the advertising slip engages an interior wall of the hollow shaft to display the advertisement; and installing the cup made of a molded resilient material to the second end of the hollow shaft, the cup being shaped to form to a golf ball and facing away from the hollow shaft.

2. The method of claim 1, wherein the advertising slip is removably disposed within the hollow shaft.

3. The method of claim 1, wherein the hollow shaft is made of acrylic.

4. The method of claim 1, wherein the cap is comprised of a molded rubber compound.

5. The method of claim 1, wherein the cup is comprised of a molded rubber compound.

6. The method of claim 1, wherein the hollow shaft further comprises a hanging means removably disposed near the first end of the hollow shaft.

7. The method of claim 1, wherein the flexible material comprises plastic or paper.

8. The method of claim 1, further comprising installing a hanging means near the first end of the hollow shaft.

* * * * *